US007143791B1

(12) United States Patent
Van Loon

(10) Patent No.: US 7,143,791 B1
(45) Date of Patent: Dec. 5, 2006

(54) SINGLE PIECE WIRE WINDING TOOL AND METHOD

(76) Inventor: John Arnold Van Loon, 807 Riverpoint Dr. Apt 401 D, Naples, FL (US) 34102

( * ) Notice: Subject to any disclaimer, the term of this patent is extended or adjusted under 35 U.S.C. 154(b) by 145 days.

(21) Appl. No.: 10/863,450

(22) Filed: Jun. 8, 2004

(51) Int. Cl.
*B21F 1/06* (2006.01)

(52) U.S. Cl. ..... 140/104; 140/124

(58) Field of Classification Search ..... 140/104, 140/102.5, 106, 117, 118, 123, 124; 72/458, 72/479; 7/106
See application file for complete search history.

(56) References Cited

U.S. PATENT DOCUMENTS

| | | | | | |
|---|---|---|---|---|---|
| 2,438,984 | A | * | 4/1948 | Adams | 140/104 |
| 3,168,118 | A | * | 2/1965 | Holman | 140/118 |
| 4,195,401 | A | * | 4/1980 | Galloup | 29/764 |
| 4,421,145 | A | * | 12/1983 | Broberg, Jr. | 140/104 |
| 5,309,954 | A | * | 5/1994 | Franssen | 140/104 |
| 5,359,782 | A | * | 11/1994 | Langmaid | 33/415 |
| 5,520,227 | A | * | 5/1996 | Kelley | 140/102.5 |
| 5,839,201 | A | * | 11/1998 | Young | 33/451 |

* cited by examiner

*Primary Examiner*—Derris H. Banks
*Assistant Examiner*—Teresa M. Bonk
(74) *Attorney, Agent, or Firm*—D. D. McGraw

(57) ABSTRACT

A single piece wire winding tool for winding a first part of a wire about a second part of the wire while providing a loop in the wire intermediate the first and second wire parts. One of the contemplated uses is that of making wire leaders for fishing tackle. The tool has a longitudinal axis, a slotted end defined by cheeks with their inner surfaces being the sided of the slot, and a hole formed with its axis perpendicularly skew to the tool's longitudinal axis and extending through the cheeks and therefore opening through the slot. The method aspect of the invention relates to the manner of using the tool to accomplish the desired winding of the wire. The wire to be wound has the first part laid in the slot and extending beyond the slot to provide the remainder of a leader. The second wire part is inserted through the hole and extends for a relatively short distance beyond the hole. The portion of the second wire part within the slot is positioned so that the wire first part is contained between that portion of the wire second part and the base surface of the slot. While the wire loop is held against rotation, the tool is moved to rotate about the wire first part which is within the slot, and this causes the part of the wire second part which is outside of the hole and adjacent the loop to be spirally wound about the wire first part in the portion of it that is between the loop and the portion lying in the slot.

20 Claims, 2 Drawing Sheets

SINGLE PIECE WIRE WINDING TOOL AND METHOD

BACKGROUND OF THE INVENTION

1. Field of the Invention

The invention relates to winding tools for winding wires, and more particularly to such tools preferably consisting of a simply constructed single piece for winding first parts of wires about second parts of the wires while forming a loop with parts of the wires which are intermediate the first and second wire parts. This type of winding is particularly useful to form wire leaders for use as leaders for fishing tackle such as fish hooks, flies, plugs, lures and live bait. The invention also includes the method of using the single piece tool to wind wires.

2. Description of the Related Art

The following U.S. Patents are the closest prior art known to the inventor at the time of filing. None of these disclosures includes a wire winding tool U.S. Pat. No. 6,185,858—Michael C. Choron, filed May 18, 1998 and issued Feb. 13, 2001

U.S. Pat. No. 5,542,843—Michael T. Price, filed Mar. 22, 1995 and issued Aug. 6, 1996

U.S. Pat. No. 5,309,954—David J. Franssen, filed Sep. 1, 1992 and issued May 10, 1994

U.S. Pat. No. 5,297,593—Robert P. Holzman, filed Feb. 6, 1993 and issued Mar. 29, 1994

U.S. Pat. No. 5,280,812—Richard S. Bigelow, filed Nov. 20, 1992 and issued Jan. 25, 1994

U.S. Pat. No. 4,901,774—David J. Goulet, filed May 1, 1989 and issued Feb. 20, 1990

U.S. Pat. No. 4,421,145—Dewey O. Broberg, Jr., filed Apr. 26, 1982 and issued Dec. 20, 1983

U.S. Pat. No. 3,861,430—Elwin G. Story, filed Nov. 5, 1973 and issued Jan. 21, 1975

U.S. Pat. No. 3,578,035—Orval Parker, filed Feb. 25, 1969 and issued May 11, 1971

U.S. Pat. No. 3,374,805—E. Schroeder, filed May 10, 1965 and issued Mar. 26, 1968

U.S. Pat. No. 3,221,779—W. J. Noel, filed Aug. 29, 1962 and issued Dec. 7, 1965

U.S. Pat. No. 3,168,118—J. G. Holman, filed Feb. 21, 1963 and issued Feb. 2, 1965

U.S. Pat. No. 3,092,152—T. Neff, filed Apr. 17, 1961 and issued Jun. 4, 1963

U.S. Pat. No. 3,030,984—P. E. Vogt et al, filed May 31, 1960 and issued Apr. 24, 1962

U.S. Pat. No. 2,934,100—H. J. Huber et al, filed Nov. 23, 1954 and issued Apr. 26, 1960

U.S. Pat. No. 2,824,583—P. D. Knoester, filed May 25, 1955 and issued Feb. 25, 1958

U.S. Pat. No. 2,454,997—I. Diamond, filed Mar. 16, 1944 and issued Nov. 30, 1948

U.S. Pat. No. 2,438,984—E. M. Adams, filed Feb. 14, 1945 and issued Apr. 6, 1948

U.S. Pat. No. 2,006,355—J. K. Howell, filed Aug. 22, 1934 and issued Jul. 2, 1935

U.S. Pat. No. 1,779,733—R. H. Hambly, filed Nov. 21, 1929 and issued Oct. 28, 1930

U.S. Pat. No. 1,038,052—C. K. Wolf, filed May 23, 1910 and issued Sep. 10, 1912

U.S. Pat. No. 852,836—M. Hays, filed Nov. 14, 1906 and issued May 7, 1907

U.S. Pat. No. 815,754—D. C. Smith, filed Aug. 15, 1904 and issued Mar. 20, 1906

U.S. Pat. No. 775,143—K. K. Lerol, Jr., filed Mar. 21, 1904 and issued Nov. 15, 1904

U.S. Pat. No. 620,826—J. R. Bardelmeier, filed Dec. 1, 1898 and issued Mar. 7, 1899

U.S. Pat. No. 608,467—H. L. Maitland, filed Dec. 5, 1895 and issued Aug. 2, 1898

Of these, U.S. Pat. No. 2,438,984—E. M. Adams, U.S. Pat. No. 1,779,733—R. H. Hambly and the earlier-issued ones listed above are the most pertinent. These have a single piece tool which is used in a stage of twisting or coiling parts of one wire around or to another, usually in the field of fencing manufacture or installation or splicing two wires together to make a longer wire. They also typically require the separate preforming of either one or both of the wires being used, and the use of other tools to accomplish one or more stages. Some of them accomplish the winding stage by rotational movement of the tool, but this must be preceded by some previous bending and preparation of one or both of the wires. Even when the patents disclose the making of a loop or eye in a wire, that is still true. None of them have a single tool provided with a slot and a hole so that they can take a single wire, insert its ends into parts of a single tool and twist one of the wire ends about the other wire end to form a loop on one wire end, as is taught and claimed herein.

BRIEF SUMMARY OF THE INVENTION

The tool embodying the invention preferably consists of a simply constructed single piece having a slot through which one part of a wire is placed so that the wire extends generally transversely of the tool, and another part of the wire has its end received through a hole that is formed through the cheeks forming the slot side walls so that the another wire part in the hole is located skew but substantially perpendicular to the wire one part within the slot. The two wire parts are connected to a loop part of the wire formed incipiently formed as a loop between the wire one and the wire another part when the two wire parts are placed or inserted as above described in the slot and the hole of the tool. The loop part is held against rotation as the tool is rotated about the axis of the wire one part, causing some of the second part of the wire, which is located between wire part extending through the hole and the wire loop part, is spirally wound about the section of the wire one part positioned just before it enters the slot. The tool being disclosed and claimed is therefore the tool body having the slot and the hole therein for receiving the two wire parts, the tool body preferably being made as a single piece and being rotatable about the axis of the wire one part to wind a part of the wire other part about a part of the wire one part. If any wire winding tool is purposely made of two or more parts in an effort to avoid any claim herein, but functions the same as if the tool were made in a single piece, such a tool is considered to be within the purview of the invention as claimed. The tool may be rotated and the loop part may be held by hand when wire of the typical fishing tackle leader wire is being wound. If wires which are very resistant to being wound because they are too large in diameter or too stiff, the loop may be held against rotation mechanically in a suitable clamp or vise and the single element tool may be driven by a rotatable power source such as a power drill tool or, in even larger applications machinery similar to a lathe.

BRIEF DESCRIPTION OF THE SEVERAL VIEWS OF THE DRAWING

FIG. 15 shows a circular cross section tool body, FIG. 16 shows an oval cross section tool body, and FIG. 17 shows an elliptical cross section tool body.

DETAILED DESCRIPTION OF THE INVENTION

Figure 1:
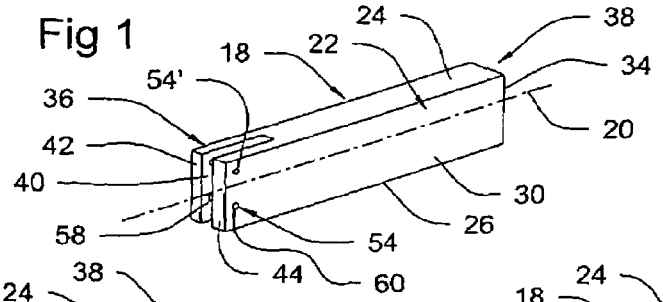
FIG. 1 is a perspective view of a single piece tool embodying the invention.

Tools embodying the invention are either made from plastic bar stock and machined to provide the finished tool, or are formed by other procedures such as injection molding. Tools embodying the invention, particularly when used in heavy duty winding applications, may be made of metal which will resist wear and tear in the tool slot and hole being described. Even for small manually operated conditions, such metal tools will last longer than plastic, but will usually be more expensive. The single piece tool 18, shown in FIG. 1, is such a tool. When referring to upper and lower, vertical or horizontal and similar directions in the descriptions below, such terms are used only for reference purposes as the tool 18 and other similar elements described are presented in the drawings. Obviously, when using the tool or just leaving it on some surface or in a tackle box, these directions are not applicable, yet for reference purposes they simplify the descriptive procedure. Similarly, the single piece tool 18, and other similar single piece tools described herein, are described as having a longitudinal direction and therefore a longitudinal axis 20, which simply is a manner of reference to the direction of their lengths overall as compared to their widths or thicknesses, their lengths being their longest extending direction, which extends from one of a tool's end surfaces to its respective opposite one of its end surfaces, later described and identified. Their widths, which may be vertical or horizontal when referring to their orientations used in the drawings, will refer to the distances between their opposing side surfaces, two of which are considered to be upper and lower side surfaces which are considered to be in horizontal planes , and two others of which are considered to be in vertical planes as presented in the drawings. Likewise, the end surfaces of a tool embodying the invention are considered to be in vertical planes, all for simplified descriptive purposes only and not further requiring the specific orientation of any single piece tool while being used or while being stored.

Tool 18 is a single piece, and includes a longitudinally extending axis 20 and therefore a longitudinally extending body section 22 which may have any of several overall shapes, but for simplicity in manufacturing, packaging and use, is essentially a three-dimensional, rectangularly shaped body section having relatively narrow upper and lower side surfaces 24 and 26, relatively wide side surfaces 28 and 30, and end surfaces 32 and 34. Surfaces 24, 26, 28 and 30 are illustrated as being parallel to the tool's longitudinal axis 20, and surfaces 32 and 34 are illustrated as being at right angles to that axis with that axis passing through their centers. These parallel and right angle descriptions do not limit the tools to such restrictions, it being within the purview of the invention that there may be modifications made to the precise shape and relative locations of these surfaces, and that at least some of these surfaces may not be planar as shown, but may be shaped to make them easier to hold, use and manipulate the tool as will be described. The body section 22 has opposed ends 36 and 38 respectively having end surfaces 32 and 34 thereon.

End 36 has a slot 40 formed therethrough, which opens through the entire vertical length of end surface 32 and also through the parts of upper and lower side surfaces 24 and 26 also forming parts of the end 36. The portion of body section end 36 having slot 40 therein therefore provides laterally spaced cheeks 42 and 44 which are laterally separated by slot 40.

The slot 40 may be formed in different shapes, such as the rectangular shape of it shown as slot 46 in FIGS. 2 through 5 or the modified trapezoidal shape shown in FIGS. 6 through 9 as slot 48. Slot 46 has its base surface 50 being substantially perpendicular to the surfaces 24 and 26 as well as the surfaces 28 and 30. Slot 46 may have either a square or other rectangular configuration, depending upon the desired depth.

Slot 48 also opens through the entire vertical length of end surface 34 and also through the parts of upper and lower side surfaces 24 and 26 of the body section 22 which are considered to be parts of the tool end 36. However, it is not as deep from the end surface 32 where it intersects lower surface 26, so that its base surface 52 is not perpendicular to the upper and lower surfaces 26 and 28, but is slanted at an angle. The precise amount of such angular slant, identified as angle "s" in FIG. 7, in relation to the axis 20, is on the order of about five degrees to about forty-five degrees, and is preferably at about 30 degrees as shown. In each of the single piece tools embodying the invention and having slot 40, 46 or 48, there is a hole 54 drilled perpendicularly to axis 20 but skew to it, being located below that axis as shown in the drawings. Hole 54 extends through the body 22 of the tool, passing through both side surfaces 28 and 30 so that its axis 56 passes through cheeks 42 and 44 and either slot 40, 46 or 48, effectively creating two spaced hole sections 58 and 60 respectively located in cheeks 42 and 44. The hole 54 and its hole sections 58 and 60 are illustrated in all of the drawings, although in some instances those hole sections are not identified by their reference numbers so as not to clutter that particular area. While not required in order for the tool 18 to function properly, a second hole 54' may be formed near the upper side surface 24 with a similar relationship to end surface 36 and to upper side surface 24 that the first-described hole 54 has with the lower side surface 26, when the slot is like slot 46. This can be used and effectively double the usable life of the tool 18 because of wear and tear. Hole 54' is shown only in FIG. 1, but it is to be understood that it can be formed and used with the tool of FIGS. 2 through 5. It is not advisable to provide such a second hole with the trapezoidal slot of FIGS. 6 through 9.

Figure 2:
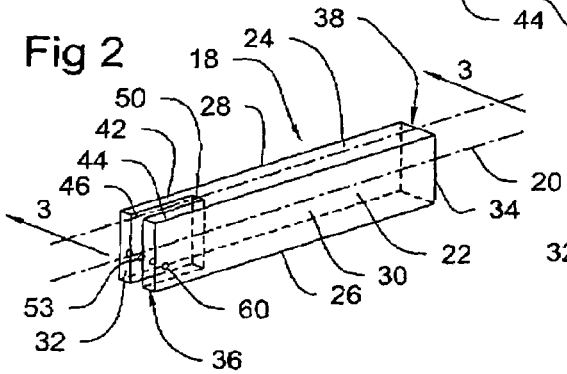
FIG. 2 is a perspective view similar to FIG. 1, showing the single piece tool's slotted tool end with the slot having its inner base substantially perpendicular to the longitudinal direction of the tool.
Figure 6:
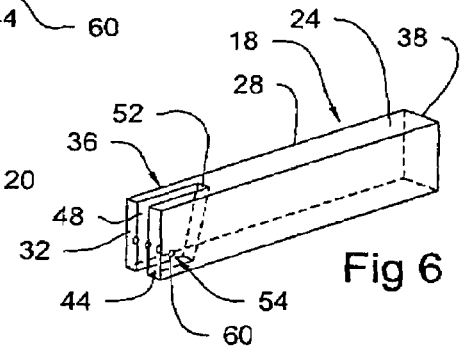
FIG. 6 is a cross section view of the single piece slotted end tool of FIGS. 1–4, taken in the direction of arrows 5—5 of FIG. 4.
Figure 3:
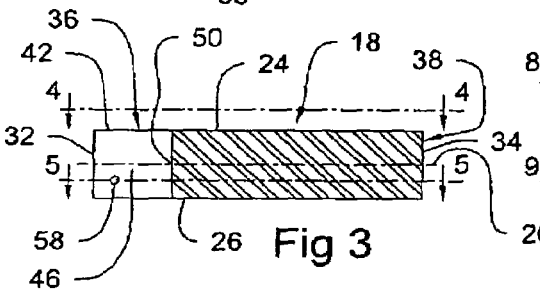
FIG. 3 is a cross section view of the single piece slotted end tool of FIG. 2, taken in the direction of arrows 3—3 of that FIGURE.
Figure 7:
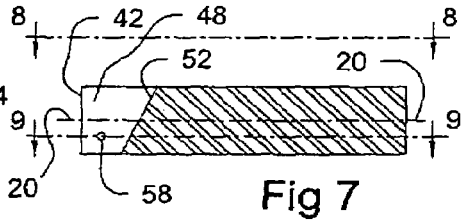
FIG. 7 is a perspective view similar to FIGS. 1 and 2 but shows the single piece slotted end tool with the slot having its inner base positioned at an acute angle to the longitudinal direction of the tool.
Figure 4:
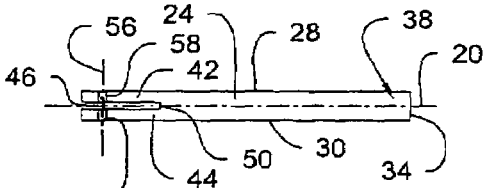
FIG. 4 is a plan view of the single piece slotted end tool of FIGS. 1 and 2, taken in the direction of arrows 4—4 of FIG. 2.
Figure 8:
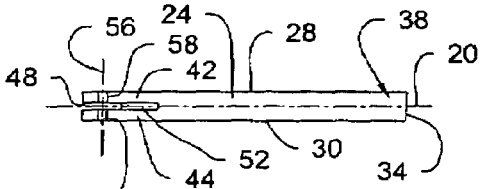
FIG. 8 is a plan view of the single piece slotted end tool of FIG. 7, taken in the direction of arrows 8—8 of that FIGURE.
Figure 5:
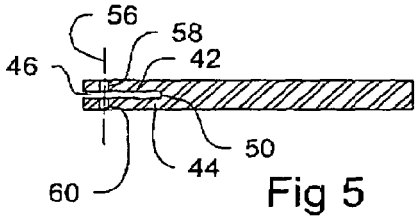
FIG. 5 is a different plan view of the single piece slotted end tool of FIGS. 1–4, taken in the direction of arrows 5—5 of FIG. 4.
Figure 9:
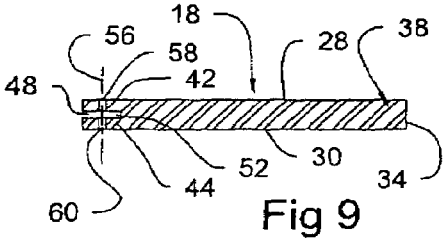
FIG. 9 is a cross section view of the single piece slotted end tool of FIG. 7, taken in the direction of arrows 9—9 of that FIGURE.

FIGS. 10 through 13 show one of the single piece tools 18 of FIG. 1, 2 or 6 as it is used to wind a wire 70 to provide a loop 72 formed by winding a first part 74 of wire 70 about a second part 76 of wire 70, with the loop 72 being formed from a third part 78 of wire 70. The second part 76 of wire 70 extends beyond the winding and in one embodiment is the leader for a fishing lure and the like. Although the primary use of the wound and looped wire is that of such a leader, single piece tools embodying the invention may be used to make other similar windings of wire for other utilitarian uses.

Figures 10, 11, 12, 13, 14, 15, 16, 17:
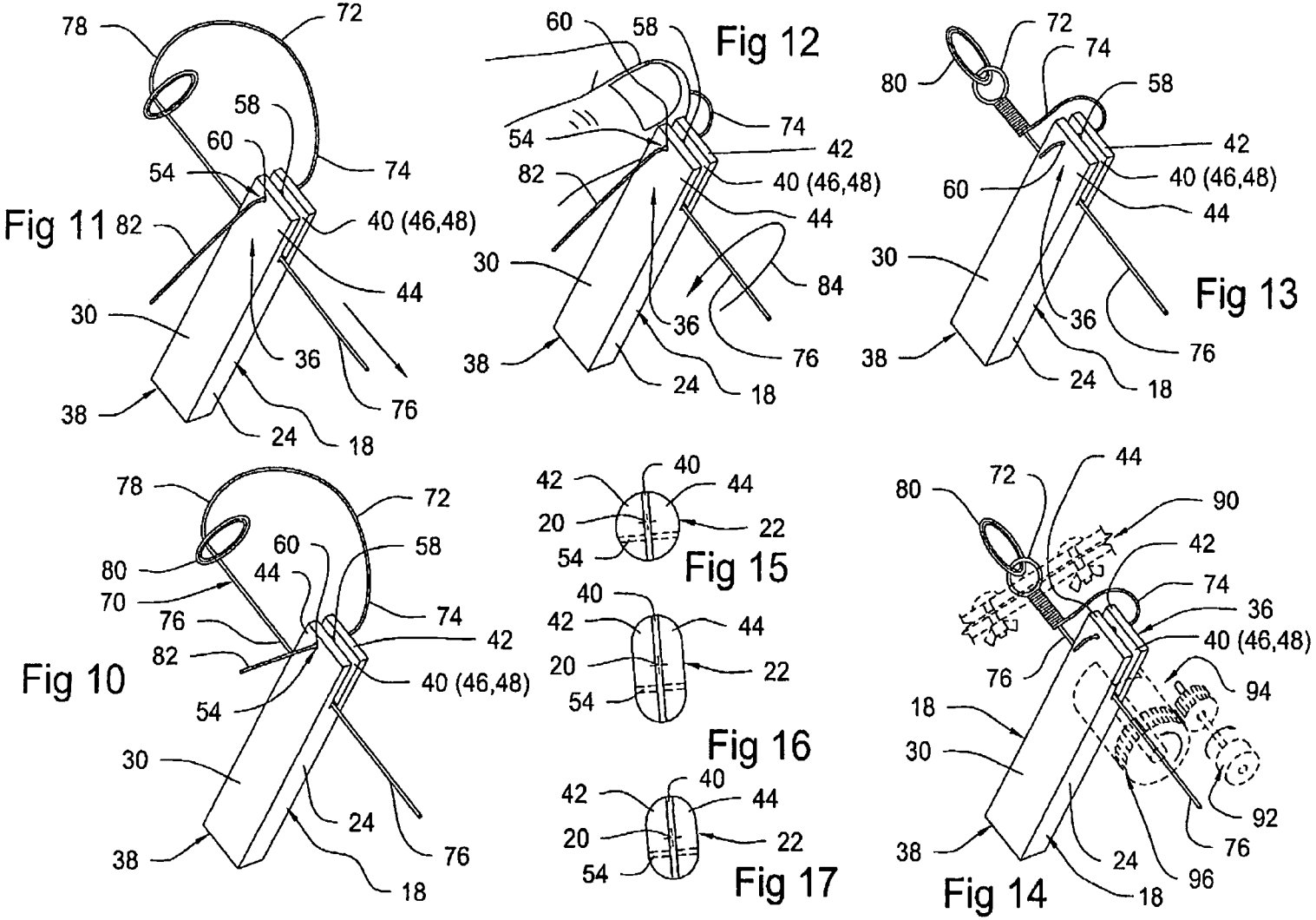
FIGS. 10 through 13 sequentially show the steps in winding a wire with the single piece tool of either of FIGS. 1 and 6.
FIG. 14 is a very simplified schematic showing the wire loop being mechanically held against rotation and the single piece tool body being power driveable when rotated.
FIGS. 15, 16 and 17 are views of the slotted ends of other tools which have different cross section configurations of the tool body.

FIG. 10 illustrates a first step in the process of winding the wire. For simplicity, it is assumed that the single piece tool 18 is as shown in FIGS. 2 through 5. Of course, the single piece tool 18 shown in FIGS. 6 through 9 can be similarly used. The wire 70 is a suitable wire diameter and made of a suitable wire material for the purposes in which it is to be used. As elsewhere noted herein, wires intended for leaders for fishing tackle are examples. The wire is of a desired length to provide the desired size loops and overall length. It has not been prebent into any shape. It is shown as having the part of it that will become the loop 72 extending through a ring 80 to which the leader to be made may later be attached to other devices. For example, when it is being attached to a fishing lure, the part of the wire which will be formed as the loop has the ring 80 positioned about the third part 78 of wire 70.

The person doing the wire winding will hold the single piece tool embodying the invention with his right hand, usually between the thumb and the fingers of that hand. At the same time, he will hold the third part 78, and the ring, of the wire 70 in his left hand, with the tool so oriented generally vertically as shown. The person first lays the second part 76 of the wire, which leads away from the loop 72, in the slot 40, 46 or 48, with the hole section 60 of hole 54 being held so that it faces him, and is therefore toward his left. The wire second part 76 extends from the slot 46 toward his right, and on to the other end of the leader being formed. The first part 74 of wire 70 then has its end 82 inserted first through the hole section 58 formed through cheek 42 and then through the hole section 60 of hole 54 formed through cheek 44 of the end 36 of the tool body section 22. Usually, when winding a wire of typical size used for leaders, wire end 82 is extended beyond the cheek 44 for about two inches, and it is then bent downwardly along the side surface 30 of tool 18 as seen in FIG. 12. The length of the wire end 82 which is so extended can determine the amount of wire that is to be used to form the turns of the winding. The second part 76 of the wire 70, having been laid in the slot 46, is therefore positioned under the wire part 76 that is within the slot 42 and extends outwardly of slot 46 to become the major length part of the leader. The person doing the wire winding then holds the loop 72 against rotation and moves the tool 18 so that it is rotated about the wire part 76 that is within the slot 46 in the counterclockwise direction as shown by circular arrow 84 in FIG. 12, as seen when one is looking back along the wire part 76 toward the slot 46, causing the wire first part 74 adjacent loop 72 and just outside of slot 46 to be wound tightly about the wire third wire part 78, with the person continuing to hold the loop 72 against rotation as the winding process proceeds. When the desired amount of wound wire has been wound about the third wire part 78, and the loop 72 will have been reduced in diameter to the desired extent, and if the length of the wire end 82 which can determine the amount of wire to be used to form the winding turns has been set for that purpose, the wire first part 74 will be pulled out of the hole 54, thus completing the number of winding turns desired. The wound part of the wire and that portion extending therefrom to form the leader is removed from the tool slot 46, and the end of the first part 74 which extends beyond the winding is preferably removed by a stub wire cutter, leaving a tightly wound part of the wire and the wire part on which it is wound. When making a leader for fishing tackle, for example, the other end of the wire is treated in the same manner so that the finished leader has a loop at each end, with the wire having been wound on that end as well.

As can be seen, when using a single piece tool 18 having the slot 46, the body section 22 of the tool 18 is rotated with the wire third part 78 being the axis of that rotation. The rotation is in a plane which is substantially perpendicular to the direction of the wire third part 78 as it extends rightward as seen in FIGS. 10 through 13. When using a tool 18 with the slanted slot back surface 52 of FIGS. 6–9, the tool 18 may be moved so that it moves in a somewhat conical pathway rather than a substantially flat circular pathway or a combination of those pathways. This may at times better accommodate the physiology of the right hand of the person doing the winding, and for some people may be a bit more comfortable while moving the body in the direction of the circular arrow 84 of FIG. 12.

It is to be understood that, if the person doing the winding is left handed, and desires to use his left hand to rotate the tool 18 during the winding process, he does the same progression of steps as shown in FIGS. 10 through 13, but reverses the single piece tool 18 so that the hole 54 is toward his right, as is the loop 72, holds the loop with his right hand, and rotates the tool 18 clockwise with his left hand, to achieve the same winding result.

When the tool 18 embodying the invention is being used to make leaders for fishing tackle, the tool is usually made of plastic such as Lexan, Lexeon, Lucite, or Plexiglass, by way of example but not limitation. Other suitable plastics may be used so long as they are sufficiently hard to withstand the winding action without substantial bending, and strong enough not to break during that action. The single piece tool 18, as well as the modifications of the tool body shown in FIGS. 2 and 6, may also be made of suitable metal, including but not limited to hardened steel. In all instances, there will be some wear on the slot base surface 50 or 52 and the inner walls of the cheeks 42 and 44, as well as the cross hole 54 and the edge of the tool body where the wire being wound exits from the hole 54 as it is being wound,, and the material chosen will have a life dependent on its resistance to such wear. That edge, formed by the abutting edges of the lower side surface 26 and the relatively wide side surface 28, is preferably at about 90° to obtain the best winding. Of course, when other shapes of the tool body 22 are used as discussed below, it is desirable to have any equivalent edge to approach that same angle.

A typical single piece tool that has been made and successfully used to make fishing tackle leaders has had a body length of about 2¼", a narrow width of about 3/16" and a wide width of about ⅝". The slot has had a depth of about 5/16" from the outer end surface 32 to its base surface 50. When made with the slanted slot base surface 52, the base surface where it is intersected by the axis 20 is about 5/16" from the outer end surface 32. The hole 54 is located about 3/16" from the lower side surface 26 and the same distance from the outer end surface 32. That hole may be about the diameter of a #54 drill, which will accommodate leader wire having diameters such as 0.012" (32 lb. test); 0.020" (86 lb. test); 0.0295 (174 lb. test). These are typical leader wire sizes commercially available from American Fishing Wire™. Other wires for that purpose are provided by other manufacturers, and these are given only as an example. Wires up to 0.0358" have been successfully wound by devices embodying the invention. While devices embodying the invention can wind wire smaller that 0.012" such smaller wires are not considered to be very practical as fishing tackle leaders.

FIG. 14 illustrates that single piece tools embodying the invention, the tools being used to wind considerably larger diameter wires than those used to make most fishing leaders. Whether to make large fishing tackle leaders or other similar wire devices, the single piece tool 18 will also likely be larger, and, if the force required to wind the wire is sufficient to require mechanical assistance, the process or method aspect of the invention may be adapted to holding the wire loop section in a vise or similar gripping tool schematically illustrated and identified by the reference numeral 90, and driving the tool body in its rotational movement to wind the wire by a power device 92 connected to move the tool body in the same movements that are illustrated as being done by hand with smaller diameter wires. The power device 92 may simply be a power drill with properly adapted tooling such as a slotted rod end 94 which fits over the body of the single piece tool and is operatively attached at 96 to the power drill for rotation, or may be part of a fixed installation. The operative attachment 96 is illustrated very schematically as a geared drive so that the power device 92 is offset from the axis of rotation of the tool body. The single piece tool embodying the invention therefore has a considerably wider range of uses than just for winding and making fishing tackle leaders.

FIGS. 15, 16 and 17 respectively show that the tool body 22 may have other cross section configurations. FIG. 15 shows a tool body cross section which is circular. FIG. 16 shows a tool body cross section which is oval. FIG. 17 shows a tool body cross section which is elliptical. Thus, the circular configuration has a constant radius in cross section, while the oval and elliptical configurations have a variable radius in cross section. In each of these FIGURES, the slot 40 (46, 48), cheeks 42 and 44, and hole 54 are shown.

The invention claimed is:

1. A fishing tackle leader winding tool for winding a wire having a first part and a second part and an intermediate part so that the wire first part is wound about the second part and the intermediate part forms a loop, said tool comprising:

a tool body having a longitudinal axis and first and second axially opposed ends through which said axis extends, and a first end surface on said first axially opposed end and a second end surface on said second axially opposed end and an external side surface laterally spaced from said tool body longitudinal axis and abutting said first and second end surfaces, said external side surface comprising at least one tool body external side surface;

said first axially opposed end having a slot extending therethrough and opening through said first end surface and through said external side surface and thus dividing said first opposed end into two cheeks, said slot having a base surface extending between said cheeks and defining the inner end of said first axially opposed end, said base surface being angularly positioned relative to said tool body longitudinal axis, each of said cheeks having an inward side surface formed by said slot and an outward side surface formed be a part of said tool body side surface means;

and at least one hole extending through said cheeks with said at least one hole having a hole axis which is located laterally of said tool body longitudinal axis and is skew at about 90° thereto, said hole axis being spaced between said first end surface and said slot base surface.

2. The winding tool of claim 1 in which said hole has a diameter to permit wires with diameters which are commercially available for use as fishing tackle leaders to be inserted therein and to be moved therethrough, said hole limiting any direction of lateral movement of the wire that is within said hole when a wire is inserted therethrough, said hole diameter being of a size that permits no substantially larger diameter wires to be inserted therethrough than the wires having diameters within the range of the typical commercially available wires which are identified and sold as being suitable for fishing tackle leaders.

3. The winding tool of claim 1 in which said hole is of a diameter to permit wires having diameters within a range of 0.012" to 0.0358" to be inserted therein and to be moved therethrough, said range of diameters being substantially the range of diameters of wires that are identified and sold as being suitable for fishing tackle leaders .

4. The winding tool of claim 1 in which said winding tool body is a single piece tool of a size to be hand held and hand operated to wind a wire without requiring any additional tools or tool parts.

5. The winding tool of claim 1 in which said winding tool body external side surface is a curvilinear external side surface for the entire tool body.

6. The winding tool of claim 5 in which each of said cheek outward side surfaces is a part of said curvilinear side surface.

7. The winding tool of claim 5 in which said curvilinear surface is substantially cylindrical with a constant radius cross-section.

8. The winding tool of claim 5 in which said curvilinear surface is substantially cylindrical with a variable radius cross section.

9. The winding tool of claim 1 in which said winding tool body external side surface includes a plurality of side surface sections.

10. The winding tool of claim 1 in which said winding tool body external side surface includes at least four side surface sections.

11. The winding tool of claim 1 in which said winding tool body external side surface has a first two substantially parallel side surface sections located on opposite sides of said tool body longitudinal axis and having an established width, and a second two substantially parallel side surface sections located on opposite sides of said tool body longitudinal axis so as to be substantially parallel to each other and substantially perpendicular to said first two substantially parallel side surface sections and having an established width which is at least half of the established width of said first two substantially parallel side surface sections.

12. The winding tool of claim 11 in which each of said cheek outward side surfaces is a part of one of said first two substantially parallel side surface sections.

13. The winding tool of claim 1, said hole being adapted to receive an end part of the wire first part therethrough and said slot being adapted to receive an end part of the wire second part therethrough so that it is positioned on said slot base surface and underneath the portion of the end part of the wire first part which is between said cheeks, and therefore the wire intermediate part which joins the wire first and second parts may form a loop adapted to be located outside said slot where said slot extends through said tool body external side surface means on the side thereof closer to said hole axis and also adapted to be located beyond the surface section of said tool body external side surface forming an external side surface of one of said cheeks; the wire loop being adapted to be held against rotation and said tool body being adapted to be rotated about its longitudinal axis so as to cause the wire first part to be wound tightly around the wire second part positioned between the loop and the first opposed end surface.

14. The winding tool of claim 13 in which the wire loop is adapted to be held against rotation by a mechanical device and said tool body is adapted to be rotatably driven about its longitudinal axis by a power device.

15. A single piece wire winding tool having an elongated body having a longitudinal axis, said elongated body having opposed ends defined in part by end surfaces of said elongated body and also having a continuous body side surface which extends between said end surfaces and surrounds said body, said continuous body side surface comprising one or more body side surface sections surrounding said body;

said opposed ends having a slot formed therein extending from its end surface axially of said body and also extending through said one opposed end transversely of said body through oppositely positioned portions of said body side surface means so that opposed cheeks are formed as part of said one body opposed end which are separated by said slot, said slot having slot side surfaces formed by said cheeks and a bottom surface which is also part of said one body opposed end;

and a hole having its axis extending transversely of said body and skew to said body longitudinal axis so that said hole is located closer to one of said oppositely positioned sections of said body side surface than it is to the other of said oppositely positioned sections of said body side surface, said hole being formed through said cheeks with a first hole section being in one of said cheeks and a second hole section being in the other of said cheeks.

16. The wire winding tool of claim 15, said slot being adapted to receive therethrough a first end of a wire lying immediately adjacent said slot end surface, an intermediate part of the wire to be wound to form a loop with the wire having the first wire end on one side of that intermediate part and a second end on the other side of that intermediate part, and said hole being adapted to receive therethrough the second end of the wire to be wound with the part of the wire first end lying within said slot located between the second end of the wire and said slot end surface, the loop being formed by an intermediate part of the wire which is intermediate the wire first and second ends and that intermediate part being adapted to be held while said tool body is rotated about the wire first end and the wire adjacent the wire second end being wound about the wire first end with the wire first end extending well beyond said slot to provide a desired length of a leader, said hole at all times preventing any substantial lateral movement of any part of the wire extending therethrough.

17. The method of winding a wire first part about a wire second part and forming a loop from a third wire part which is intermediate the wire first and second parts, the method comprising:

(A) providing a winding tool as defined by claim 1;

(B) inserting an end part of the wire first part through and beyond the hole and bending that end part where it exits the hole so that it lies near the tool body external side surface means;

(C) inserting an end part of the wire second part through the slot so that it lies close by the slot base surface and between the portion of the wire first part passing through the slot so that it extends beyond the tool body external side surface means a desired distance to provide a leader of a desired length;

(D) holding the wire intermediate part against rotation and (E) rotating the tool body about the portion of the wire second part passing though the slot, thus causing the wire first part where it joins the loop formed by the intermediate wire part to be tightly wound around the wire second part until the desired number of winding turns are achieved.

18. The method of claim 17 in which in step (E), as the tool body is being rotated, concurrently exerting a drag force on the end part of the wire first part which extends beyond the hole and is bent where it exits the hole, controlling the tightness of the wire winding by the amount of drag force exerted on that end part of the wire first part.

19. The method of claim 17 in which the force exerted in step (E) which is required to rotate the tool body is exerted by a hand holding the winding tool.

20. The method of claim 17 in which the holding force exerted in step (D) to hold the wire intermediate part against rotation is exerted by a hand and the force exerted in step (E) which is required to rotate the tool body is exerted by a hand holding the winding tool.

* * * * *